United States Patent [19]

Lang et al.

[11] Patent Number: 4,741,880

[45] Date of Patent: May 3, 1988

[54] STEEL

[75] Inventors: Cestmir Lang, Oberhausen; Lutz Meyer, Vörde, both of Fed. Rep. of Germany

[73] Assignee: Thyssen Stahl AG, Duisburg, Fed. Rep. of Germany

[21] Appl. No.: 13,613

[22] Filed: Feb. 12, 1987

[30] Foreign Application Priority Data

Feb. 15, 1986 [DE] Fed. Rep. of Germany ..... 3604789

[51] Int. Cl.[4] ..... C22C 38/28

[52] U.S. Cl. ..... 420/104; 420/105; 420/109; 420/112; 420/125; 420/128; 148/334; 148/333; 148/335

[58] Field of Search ..... 420/109, 110, 112, 125, 420/128; 148/320, 328, 333, 334, 335; 164/476, 477

[56] References Cited

U.S. PATENT DOCUMENTS 3,259,488 7/1966 Nakamura ..... 420/109

FOREIGN PATENT DOCUMENTS 58-221259 12/1983 Japan ..... 420/125

810832 3/1981 U.S.S.R. ..... 420/125

*Primary Examiner*—Deborah Yee

*Attorney, Agent, or Firm*—Sprung Horn Kramer & Woods

[57] ABSTRACT

A continuously cast steel consisting of 0.32 to 1.0% carbon 0.20 to 3.0% manganese, up to 2.0% silicon, max. 0.05% phosphorus, max. 0.05% sulphur, 0.002 to 0.008% nitrogen, 0.015 to 0.08% zirconium, 0.010 to 0.10% aluminium, up to 3.5% chromium, up to 3.5% nickel and up to 0.5% molybdenum rest iron and unavoidable impurities, wherein the zirconium: nitrogen ratio being 7:1 to 10:1 and the austenite grain size being ASTM 6 or a smaller grain size number.

8 Claims, No Drawings

STEEL

The invention relates to a continuously cast steel with good hardenability.

Hardness penetration is a measure of the hardenability of steels. As a rule it is defined as that distance from the surface at which 50% of the structure steel consists of martensite.

For reasons of hardenability, unalloyed and alloyed heat-treated steels require a coarse austenite grain (ASTM number 6 or smaller No.) during austenitization prior to hardening. Hitherto the coarse austenite grain has been obtained by limiting the maximum aluminium content to 0.005% with ordinary and 0.010% with elevated austenitization temperatures.

Hitherto it has been impossible to produce heat-treatable steels with good hardenability by continuous casting, a process requiring minimum aluminium contents of the order of magnitude of more than 0.010%, for reasons of castability and the properties of the product. This is a considerable disadvantage, due to the increased use of the economical continuous casting process in the steel industry.

If such steels were to be completely killed with aluminium, the aluminium nitrides formed in the course of austenitization or already present would cause grain refining by nucleation or by impeding the growth of the austenite grain. In dependence on the aluminium or nitrogen contents, with the usual austenitization temperature of about 800° to 860° C. a fine austenite grain would be formed in these steels and heavily reduce their hardenability.

With steels having aluminum contents of more than 0.015%, such as are present with full aluminium killing, austenitization temperatures of the order of magnitude of between 950° and 1050° C. would be required to obtain a coarse-grained austenite. Such austenitization temperatures cannot be considered, for reasons of energy costs, technical plant limitations and relatively heavy scaling.

It is true that the loss of hardenability in aluminium-killed heat-treatable steels can be compensated by the addition of alloying elements, such as manganese or chromium, but these steps can be performed only with limitations. Quite apart from the negative effects of the aforementioned elements, more particularly deterioration of cold formability, the individual steel qualities must be supplied in accordance with predetermined analytical regulations, departures from which are not tolerated.

It is an object of the invention to obviate the disadvantageous influence of aluminum on the hardenability of steels using acceptable and economic means, and to provide a steel with improved hardenability which can be produced inexpensively by the continuously casting process.

To this end the invention provides a steel having 0.32 to 1.0% carbon,
0.20 to 3.0% manganese,
up to 2.0% silicon,
max.0.05% phosphorus,
Max 0.05% sulphur,
0.002 to 0.008% nitrogen,
0.010 to 0.10% aluminium,
rest iron and unavoidable impurities, which contains an additional content of 0.015 to 0.08% zirconium, the zirconium/nitrogen ratio being 7:1 to 10:1 and the austenite grain size being ASTM 6 or a smaller grain number (coarser grain size). (Determination of the austenite grain size according to ASTM (American Society for Testing and Materials) is performed to ASTM Standard E 112; cf. also the German Iron and Steel Test Sheet 1510).

The addition of zirconium, an element which has a high affinity to nitrogen, prevents the aluminium nitride precipitation in the steel which would lead to a fine austenite grain. In contrast, the addition of zirconium causes the formation of coarse nitrides even during the solidification of the steel. It has surprisingly been found that the zirconium/nitrogen ratio of 7:1 to 10:1 produces with the usual austenitization temperatures of about 800° to 860° C. and holding times over 10 minutes a coarse austenite grain (ASTM/No. 2 to 6) which corresponds to that of a silicon-killed steel. An addition of zirconium produces outstanding hardenability independently of the carbon content.

Preferably the carbon content is 0.41 to 1.0%, the manganese content 0.20 to 2.0%, the silicon content up to 0.5%, the nitrogen content 0.002 to 0.0065%, the aluminium content 0.015 to 0.08% and the zirconium content 0.015 to 0.065%. However, the heat-treatable steel acquires outstanding hardenability even with still lower manganese contents of 0.20 to 1.2% or 0.40 to 1.0%.

The heat-treatable steel according to the invention can also receive additions of chrome, nickel, molybdenum individually or in combination namely 0.05 to 3.5%, more particularly 0.05 to 1.5% chromium and/or nickel and/or 0.05 to 0.5% molybdenum.

However, so as not to adversely affect the satisfactory hardenability of the steel according to the invention, it must contain no alloying elements, such as niobium or titanium which would lead to a fine grain in the austenite and moreover acceleraate the austenite transformation in the ferrite-perlite stage during hardening via nuclei in the structure.

It is known to add zirconium to alloyed structural steels to improve cold formability. However, the influence of an addition of zirconium on nitride formation and therefore its influence on coarsening the austenite grain has not been mentioned (Molybdän-Dienst (=Molybdenum Service), No. 70, January 1971, pages 1-8 and Baustähle der Welt (=Structural Steels of the World), Vol. II, VEB Deutscher Verlag fur Grundstoffindustrie (=German Publishing House for Primary Industry), Leipzig 1968, pages 220-231).

In the course of an investigation of the effect of zirconium on the mechanical properties of unalloyed structural steels, similar to steel grades St 52-3, following annealing between 860° and 900° C. (normalizing) in the presence of zirconium a decrease in the quantity of separated aluminium nitride was observed, which was shown by an increase in the tendency to grain growth. Samples which were annealed between 860° and 900° C. accordingly showed proportions of coarser fine grain with increasing zirconium content. However, due to the drop in strength properties following the normalizing of structural steels, this phenomenon has been regarded as negative. Within the framework of that steel analysis no positive use could be made of coarse ZrN with a view to heat treatment, nor was such use suggested by the investigations described. (Thyssen Forschung (=Thyssen Research), 2nd Year of publication, 1970, Vol. 1, pages 35-41).

The special advantage of the heat-treatable steel according to the invention is that hardenability is adjusted to the level of silicon-killed steels without essential alteration of the analytical regulations and without adverse effect on mechanical properties, and the economic continuous casting process can be used.

A further advantage of aluminum killing and the addition of zirconium in the heat-treatable steel according to the invention is to ensure that it is resistant to ageing. The traditional heat-treated steels have free nitrogen and are therefore liable to ageing.

The production of the heat-treatable steel according to the invention and the values of austenite grain size thereby obtained will now be described in greater detail with reference to embodiments. The steel according to the invention will also be compared with heat-treatable steels not covered by the invention.

The steels A to M were melted in a basic oxygen steelmaking process. Table 1 shows the steels' chemical composition and austenite grain size, determined as a quench grain size to DIN 50601. These steels A to H are covered by the invention. The invention does not cover the steels I and J, which have no addition of zirconium, or the steels K and L, which have an aluminium content below 0.010%, or the steel M, which has a Zr/N ratio smaller than 7.

Clearly, of the aluminium-containing—i.e., satisfactorily continuously castable steels—only those with an addition of zirconium and a Zr/N ratio between 7 and 10 have an austenite grain size such as is required for satisfactory hardenability.

TABLE 1

| Steel | C | Si | Mn | P | S | Al | Cr | Zr | N | Zr:N | Austenite Grain Size ASTM No. |
|---|---|---|---|---|---|---|---|---|---|---|---|
| A | 0,32 | 0,32 | 1,50 | 0,010 | 0,010 | 0,020 | 0,15 | 0,041 | 0,0045 | 9,1 | 5 |
| B | 0,34 | 0,28 | 0,92 | 0,011 | 0,012 | 0,016 | 0,35 | 0,052 | 0,0065 | 8,0 | 5 |
| C | 0,45 | 0,35 | 0,85 | 0,009 | 0,006 | 0.019 | 1,52 | 0,060 | 0,0063 | 9,5 | 4 |
| D | 0,48 | 0,32 | 0,75 | 0,012 | 0,008 | 0,021 | 0,45 | 0,049 | 0,0054 | 8,0 | 5,5 |
| E | 0,55 | 0,37 | 0,64 | 0,011 | 0,009 | 0,017 | 0,03 | 0,039 | 0,0048 | 8,1 | 5 |
| F | 0,56 | 0,26 | 0,68 | 0,010 | 0,006 | 0,018 | 0,02 | 0,042 | 0,0045 | 9,3 | 4 |
| G | 0,65 | 0,30 | 0,72 | 0,009 | 0,006 | 0,022 | 0,04 | 0,035 | 0,0042 | 8,3 | 5,5 |
| H | 0,75 | 0,31 | 0,40 | 0,012 | 0,005 | 0,018 | 0,02 | 0,050 | 0,0054 | 9,3 | 4,5 |
| I | 0,45 | 0,28 | 0,85 | 0,010 | 0,010 | 0,040 | 0,03 | | 0,0046 | | 11 |
| J | 0,48 | 0,35 | 0,92 | 0,011 | 0,008 | 0,025 | 0,15 | | 0,0052 | | 10 |
| K | 0,35 | 0,31 | 0,65 | 0,011 | 0,006 | 0,004 | 0,02 | | 0,0050 | | 4,5 |
| L | 0,46 | 0,32 | 0,70 | 0,010 | 0,010 | 0,003 | 0,03 | | 0,0060 | | 4 |
| M | 0,55 | 0,32 | 0,89 | 0,012 | 0,007 | 0,045 | 0,02 | 0,023 | 0,0051 | 4,5 | 7,5 |

We claim:

1. A continuously cast steel consisting of
0.32 to 1.0% carbon
0.20 to 3.0% manganese,
up to 2.0 % silicon,
max. 0.05% phosphorus,
max. 0.05% sulphur,
0.002 to 0.008% nitrogen,
0.015 to 0.08% zirconium,
0.010 to 0.10% aluminium,
up to 3.5% chromium,
up to 3.5% nickel and
up to 0.5% molybdenum
rest iron and unavoidable impurities, wherein the zirconium:nitrogen ratio being 7:1 to 10:1 and the austenite grain size being ASTM 6 or a smaller grain size number.

2. A steel according to claim 1 wherein the manganese content is 0.20 to 1.20%.

3. A steel according to claim 2 wherein the manganese content is 0.40 to 1.0%.

4. A steel according to claim 1 wherein it contains
0.41 to 1.0% carbon
0.20 to 2.0% manganese,
up to 0.5% silicon,
0.002 to 0.0065% nitrogen,
0.015 to 0.08% aluminium,
0.015 to 0.065% zirconium,
up to 3.5% chromium,
up to 3.5% nickel and
up to 0.5% molybdenum.

5. A steel according to claim 4 wherein the manganese content is 0.20 to 1.20%.

6. A steel according to claim 5 wherein the manganese content is 0.40 to 1.0%.

7. A steel according to claim 1 wherein it contains
0.05 to 1.5% chromium and
0.05 to 1.5% nickel.

8. A steel according to claim 1 wherein the steel is in the quenched and tempered state.

* * * * *